United States Patent [19]

Plumridge

[11] Patent Number: 4,619,453

[45] Date of Patent: Oct. 28, 1986

[54] EXERCISE DEVICE

[76] Inventor: Lawrence H. C. Plumridge, 7 Arthur Wright Road, Fish Hoek, 7975, South Africa

[21] Appl. No.: 667,418

[22] Filed: Nov. 1, 1984

[51] Int. Cl.[4] ..... A63B 21/06

[52] U.S. Cl. ..... 272/117; 272/118; 272/900; 248/200.1

[58] Field of Search ..... 272/93, 116, 117, 118, 272/62, 900, 123; 248/231.2, 200.1, 317

[56] References Cited

U.S. PATENT DOCUMENTS

| | | | |
|---|---|---|---|
| 231,431 | 8/1880 | Judd | 272/118 |
| 404,802 | 6/1889 | Sleeper | 272/118 |
| 446,480 | 2/1891 | Stebbins | 248/200.1 X |
| 1,756,716 | 4/1930 | Whitney | 248/200.1 X |
| 2,134,451 | 10/1938 | Mogren | 272/117 |
| 2,380,487 | 7/1945 | Ackley | 248/200.1 X |
| 2,521,977 | 9/1950 | Huth | 248/200.1 |
| 4,109,907 | 8/1978 | Zito | 272/117 |

FOREIGN PATENT DOCUMENTS

| | | | |
|---|---|---|---|
| 0060798 | 9/1982 | European Pat. Off. | 272/118 |

*Primary Examiner*—Richard J. Apley
*Assistant Examiner*—Robert W. Bahr
*Attorney, Agent, or Firm*—Larson and Taylor

[57] ABSTRACT

An exercise device which includes a head structure; a weight member; an elongated flexible member attached at one end to the weight member and at the other end being attachable to a handle; and a support member attached to the suspension links and being adapted to guide the flexible member. The head attachment structure comprises two spaced engaging members, each of which is adapted to engage with connect the two spaced engaging members, and a pair of suspension links, each of which is connected at one end at one of the engaging members and which links are linked together. The combined length of the pair of links is greater than the length of the connection link. When the flexible member is pulled for lifting the weight member, a force is exerted via the attachment member on the pair of suspension links for urging the engaging member outwardly towards the vertical posts of a door frame to which the structure is fitted.

11 Claims, 8 Drawing Figures

EXERCISE DEVICE

FIELD OF INVENTION

The present invention relates to exercise devices.

More particularly, the invention relates to exercise devices for a person to execute body exercises.

BACKGROUND OF INVENTION

A number of exercise devices have been proposed for body exercises.

Examples of such exercise devices are disclosed in U.S. Pat. No. 689,418 (Ryan), 2,918,282 (Waterval), 3,155,339 (Forte), 4,084,815 (Flannery), 4,109,907 (Zito) and 4,072,308 (Applegate).

However, these known exercise devices firstly require fairly complicated attachment systems for attachment to a part of a building such as a door frame, or in some other cases the attachment is unreliable. Furthermore the known devices do not ensure the required stability in the movement of the exercising weight. This results in jerking and fluctuating forces being experienced by an exerciser which is not only disturbing, but which can result in injury.

It therefore is an object of the invention to suggest and exercise device which will assist in overcoming such disadvantage.

SUMMARY OF INVENTION

According to the invention, an exercise device includes:

(a) a head attachment structure, which comprises two spaced engaging members, each of which is adapted to engage with a vertical post of a door frame, a connection link adapted to connect the two spaced engaging members, a pair of suspension links, each of which is connected at one end at one of the engaging members and which links are linked together, the combined length of the pair of links being greater than the length of the connection link;

(b) a weight member;

(c) an elongated flexible member attached at one end to the weight member and at the other end being attachable to a handle; and (d) a support member attached to the suspension links and being adapted to guide the flexible member, such that when the flexible member is pulled for lifting the weight member, a force is exerted via the attachment member on the pair of suspension links for urging the engaging members outwardly towards the vertical post of a door frame to which the structure is fitted.

At least one elongated guide member may be connected at one end to the head attachment structure, locating means provided for connecting each guide member to a building structure remote from the suspension structure, and a stabilizing member, which is adapted to be guided by each guide member in a vertical movement, the stabilizing member being connected to the weight member.

The connection link may be adjustable in length and the suspension links may also be adjustable in length.

The stabilizing member may be in the form of a plate having holes through which each elongated guide member can pass.

BRIEF DESCRIPTION OF DRAWINGS

The invention will now be described by way of example with reference to the accompanying schematic drawings.

In the drawings there is shown in

DETAILED DESCRIPTION OF DRAWINGS

Figure 1:
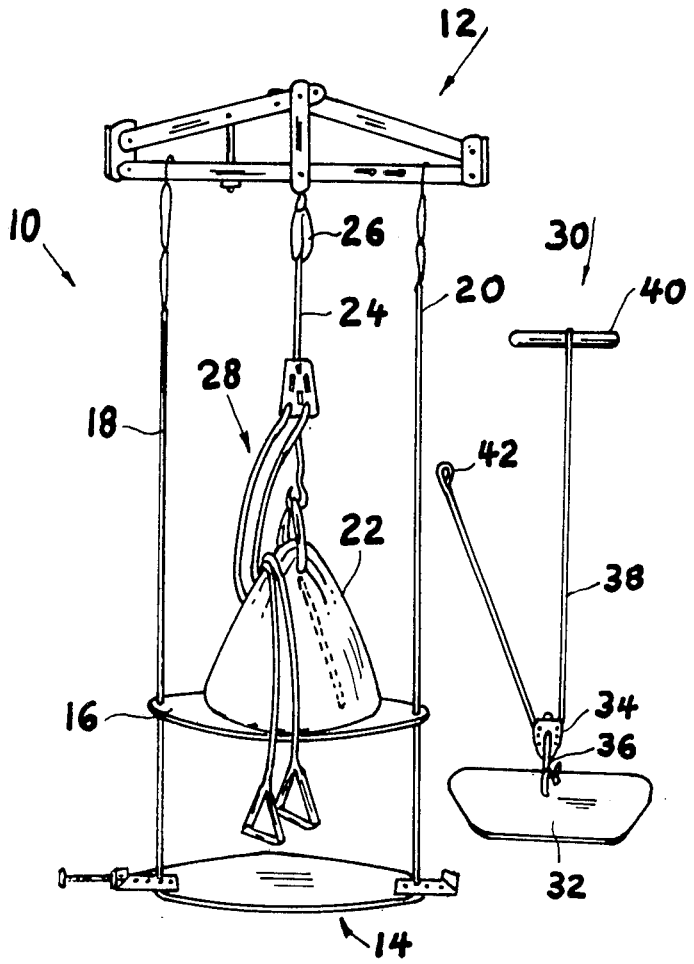
FIG. 1 a schematic front view of an exercise device in accordance with the invention indicating the various components involved.

Referring to FIG. 1, the exercise device 10 includes a head attachment structure 12, a base locating unit 14, a guide plate 16, a pair of spaced guide ropes 18, 20, a bag 22, a connecting rope 24 passing over a pulley 26, and a hand gripping arrangement 28.

Furthermore, an alternative gripping unit in the form of a foot unit 30 is provided which includes a foot plate 32, a pulley 34 attached by way of a ring 36 to the plate 32, and a rope 38 having a handle 40 at one end and a connector 42 at the other end.

Figure 2:
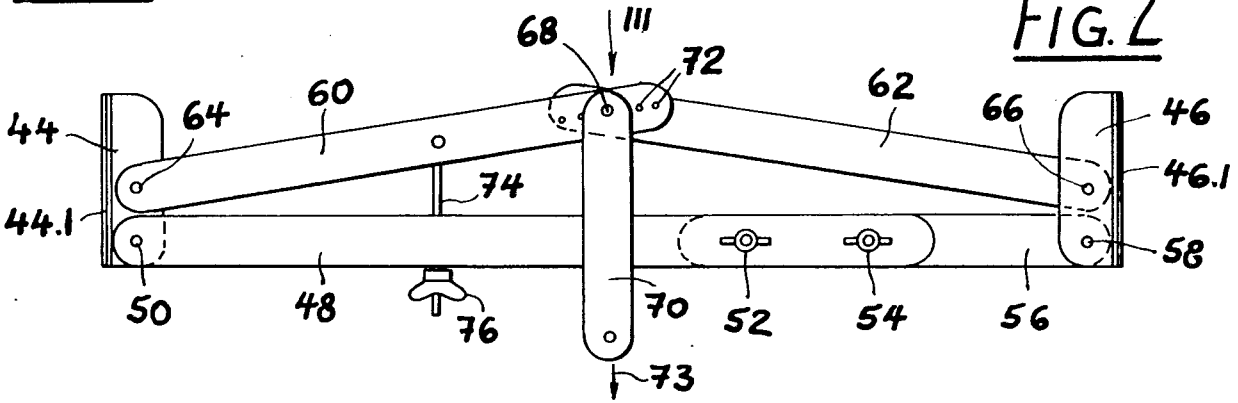
FIG. 2 on a larger scale, a front view of the head attachment structure.

Referring to FIG. 2 the head attachment unit 12 includes two T-shaped gripping plates 44, 46 which are adapted to be placed against the facing surfaces of the vertical post of a door frame. The outside faces 44.1, 46.1 may be provided with a suitable gripping layer, such as layer of rubber.

The unit 12 further includes a connection link comprising a pair of horizontal arms 48 which are pivotally connected at 50 to the plate 44 and at their opposite end are adjustably connected by means of bolt arrangement 52, 54 to an arm 56 which is pivotally connected at 58 to the gripping plate 46.

Two inclined suspension links 60 and 62 are provided. The link 60 is pivotally connected at 64 to the plate 44 and the link 62 at 66 to the plate 46. The two links 60, 62 are joined by means of a pin 68 to which also a vertical suspension plate 70 is pivotally connected. As is shown, the link 60 has adjustment holes 72 for adjusting its length. Similarly the link 62 also has holes (not shown) for adjusting its length.

The combined length of the links 60, 62 is greater than the length of the arms 48, 56. Thereby any force supplied on the plate 70 in the direction of arrow 73, will cause the links 60, 62 to push or pivot the plates 44, 46 outwardly into a greater contact with the door frame parts on which they are acting.

Figure 3:
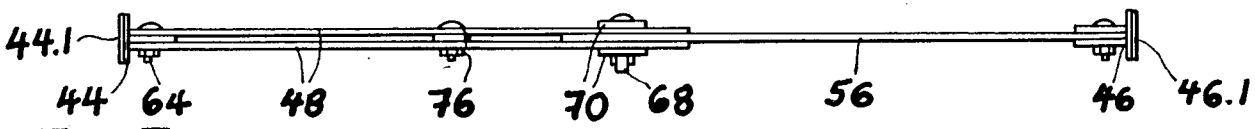
FIG. 3 a plan view of the head attachment structure seen along arrow III in FIG. 2.

The unit 12 would be placed into position between a door frame and, when the necessary adjustment has been made, would be pulled tight against the door frames and then locked in that position by means of the threaded bolt 74 and wing nut arrangement 76, the bolt 74 being pivotally connected to the link 60 and the wing nut 76 acting on the pair of arms 48 as shown in FIGS. 2 and 3.

Figure 4:
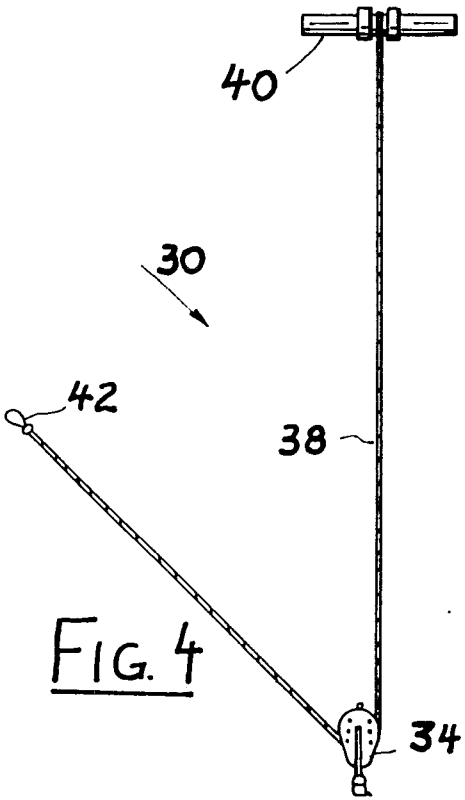
FIG. 4 a front view of one attachment of the hand gripping unit.

Referring to FIG. 4 the hand gripping arrangement 30 of FIG. 1 is shown in more detail.

Figure 5:
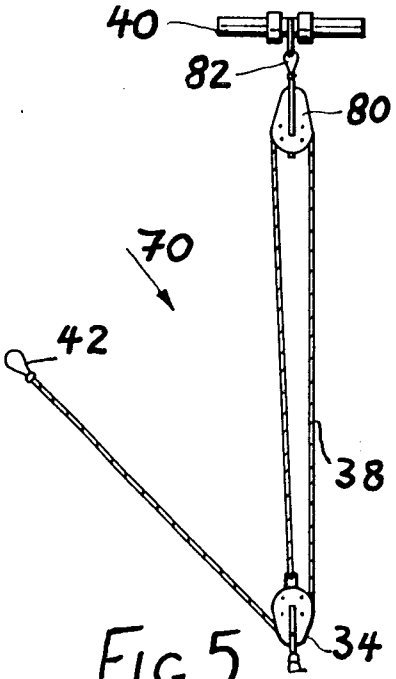
FIG. 5 a front view of a second attachment of the hand gripping unit.

In FIG. 5 a variation of the hand gripping arrangement 30 (now indicated by reference numeral 78) is shown. The same parts will be indicated by the same reference numerals as in FIG. 4. In this case an extra pulley 80, connected by means of a link 82 to the handle 40, is provided so that the rope 38 is looped through this pulley 80.

Figure 6:
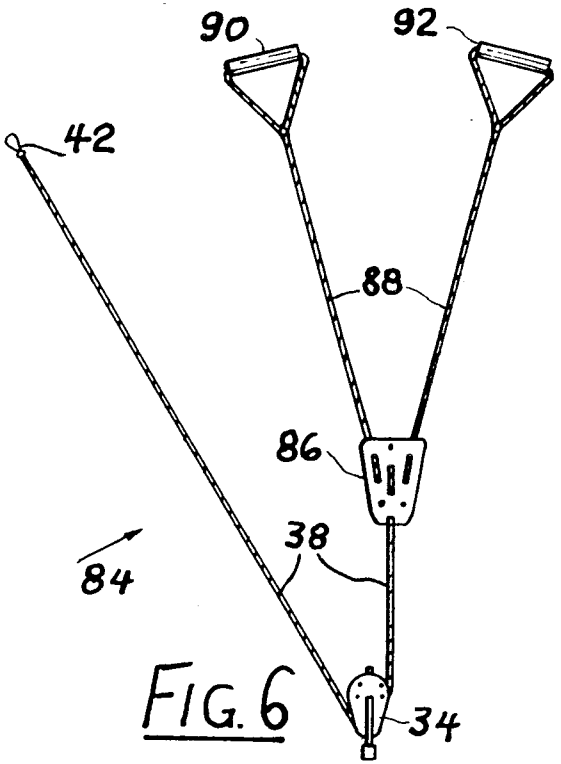
FIG. 6 a front view of a third attachment of the hand gripping unit.

In FIG. 6 the unit 84 includes a distributor plate 86 having apertures through which a rope 88 is passed, the ends of the rope 88 being attached to gripping handles 90, 92. Both hands can be used when this unit is fitted.

Figure 7:
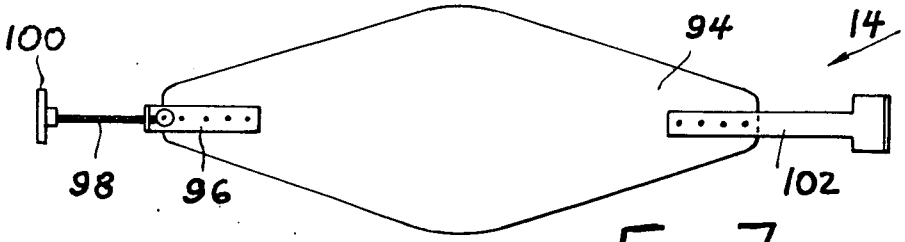
FIG. 7 a plan view on the locating plate.

In FIG. 7 a plan detail of the base unit 14 (as indicated in FIG. 1) is illustrated. The base unit 14 includes a base plate 94 having an adjustable bracket 96 at one end which receives a threaded bolt 98 having a plate 100 for attachment to a door post. On the opposite side a fixed bracket 102 is provided, which is also attachable to a door post.

Figure 8:
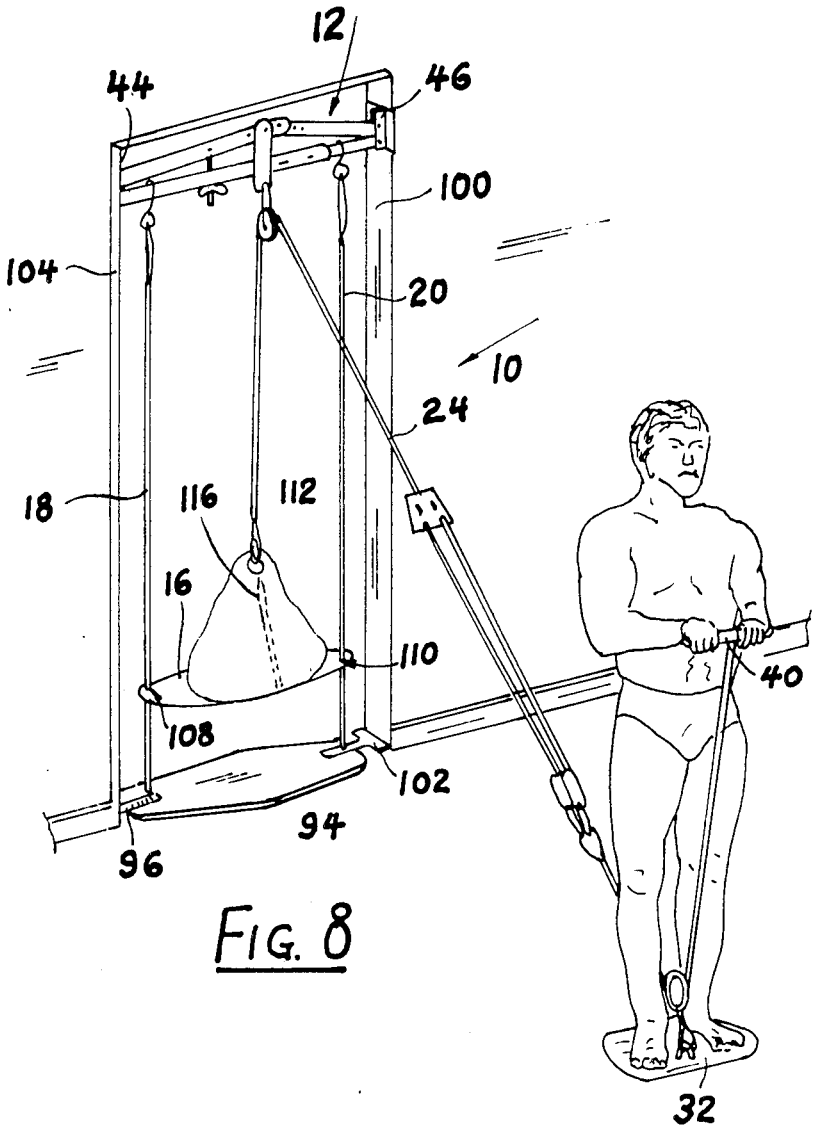
FIG. 8 a schematic view of the exercising device when fitted to a door frame.

In FIG. 8 the device 10 is shown as assembled and fitted to a door frame. As is shown the head attachment unit 12 is fitted so that is gripping plates 44, 46 abut tightly against the vertical faces of the vertical post 104, 106 of the door frame.

The base plate 94 is also fitted to the door frame by means of the adjustable bracket 96 and the fixed bracket 102.

The guide plate 16, which has holes 108, 110 through which the ropes 18, 20 pass, carries a bag 112, of which the floor is attached to the plate 16. The bag 112 has a closable opening 116 through which separate smaller bags containing liquid can be added to vary the mass as required.

In this case the exerciser stands on the foot plate 32 and by pulling the handle 40 performs the exercise as required.

For different exercises, the units as illustrated in FIGS. 3, 4 and 5 may be attached.

The plate 16 ensures that as the bag 112 is pulled up and down, no oscillations can take place but only vertical movements. Thereby any jerking forces or irregular forces are prevented.

The amount of exercise which is to be performed is varied by changing the mass of the water bags contained in the bag 112. Also by varying the gripping units, the types and amount of exercises may be varied as is required by the user of the device.

I claim:

1. An exercise device, said device comprising:

(a) a head attachment structure comprising first and second spaced engaging members for engaging respective vertical posts of a door frame, a connection link for connecting the first and second spaced engaging members together, a pair of suspension links each having a first and second end, the suspension links being connected together at their first ends, and each suspension link being connected at the second end thereof to one of the first and second engaging members, the combined length of the pair of suspension links being greater than the length of the connection link;

(b) a weight member comprising a bag for receiving removable weight units;

(c) an elongated flexible member attached at one end to the weight member and at the other end being attachable to the handle;

(d) a support member, attached to the suspension links proximate their first ends, and having means for guiding the flexible member such that when the flexible member is pulled to provide lifting of the weight member, a force is exerted by means of the support member on the pair of suspension links for urging the engaging members outwardly towards the vertical posts of a door frame to which the head attachment structure is fitted;

(e) at least one elongated guide member connected at one end to the head attachment structure;

(f) locating means for connecting said at least one guide member to a vertical post of a door frame at a location remote from the head attachment structure; and (g) a stabilizing member which is guided by said at least one guide member in a vertical direction and which is connected to the weight member.

2. A device as claimed in claim 1 in which the connection link and supension links of the head attachment structure define a triangular shape.

3. A device as claimed in claim 1, in which each engaging member is of a T-shape configuration.

4. A device as claimed in claim 1, in which the connection link is adjustable in length and the suspension links are also adjustable in length.

5. A device as claimed in claim 1, in which the guide member comprises an elongated rope.

6. A device as claimed in claim 1, in which the locating means comprises a base plate having attachment elements.

7. A device as claimed in claim 1, in which the stabilizing member comprises a plate having at least one hole through which said at least one elongated guide member passes.

8. A device as claimed in claim 1, in which the support member includes a pulley over which the flexible member passes.

9. An exercise device as claimed in claim 1 wherein there are at least two said elongated guide member connected at one end to the head attachment structure, said locating means comprises a base plate connected to said elongated guide members at a location remote from the head attachment structure and including laterally extending gripping means on opposite edges thereof for gripping the respective vertical posts of the door frame.

10. An exercise device as claimed in claim 9 wherein at least one of said gripping means is adjustable.

11. An exercise device as claimed in claim 9 wherein said stabilizing means comprises a plate having holes at spaced, opposed locations therein through which said elongated guide members pass.

* * * * *